US009226544B2

(12) United States Patent
Polegato Moretti

(10) Patent No.: US 9,226,544 B2
(45) Date of Patent: Jan. 5, 2016

(54) VAPOR-PERMEABLE SHOE WITH WATERPROOF AND VAPOR-PERMEABLE SOLE

(75) Inventor: Mario Polegato Moretti, Crocetta del Montello (IT)

(73) Assignee: GEOX S.p.A., Montebelluna (IT)

( * ) Notice: Subject to any disclaimer, the term of this patent is extended or adjusted under 35 U.S.C. 154(b) by 298 days.

(21) Appl. No.: 13/988,439

(22) PCT Filed: Oct. 14, 2011

(86) PCT No.: PCT/EP2011/067975

§ 371 (c)(1), (2), (4) Date: May 20, 2013

(87) PCT Pub. No.: WO2012/065792

PCT Pub. Date: May 24, 2012

(65) Prior Publication Data

US 2013/0239444 A1 Sep. 19, 2013

(30) Foreign Application Priority Data

Nov. 19, 2010 (IT) ..... PD2010A0348

(51) Int. Cl.
*A43B 7/06* (2006.01)
*A43B 7/08* (2006.01)
(Continued)

(52) U.S. Cl.
CPC ... *A43B 7/06* (2013.01); *A43B 7/08* (2013.01); *A43B 7/087* (2013.01); *A43B 7/125* (2013.01); *A43B 13/12* (2013.01); *A43B 13/16* (2013.01)

(58) Field of Classification Search
CPC ..... A43B 7/06; A43B 7/08; A43B 7/12; A43B 7/125; A43B 13/12
USPC ..... 36/3 R, 3 A, 3 B, 25 R, 30 R
See application file for complete search history.

(56) References Cited

U.S. PATENT DOCUMENTS 6,389,711 B1 * 5/2002 Polegato ..... 36/3 R
7,823,297 B2 * 11/2010 Polegato Moretti ..... 36/3 R
(Continued)

FOREIGN PATENT DOCUMENTS

JP H 11-513582 11/1999
JP 2009-219786 10/2009
(Continued)

OTHER PUBLICATIONS

U.S. Appl. No. 13/876,776, filed May 20, 2013, Polegato Moretti.
(Continued)

*Primary Examiner* — Marie Bays
(74) *Attorney, Agent, or Firm* — Oblon, McClelland, Maier & Neustadt, L.L.P.

(57) ABSTRACT

A vapor-permeable shoe with waterproof and vapor-permeable sole, including: an upper assembly; a sole joined to the upper assembly and including a body made of waterproof material including a tread and at least one region permeable to water vapor; a waterproof and vapor-permeable membrane, which covers the region, toward an inside of the shoe; a protective element, which covers at least partially the lower face of the membrane; and at least one waterproof and vapor-permeable protective screen superimposed, toward the inside of the shoe, on the membrane to cover it at least partially, the protective screen and the membrane being sealed in a waterproof manner to the body of the sole at at least one sealing zone peripheral to the region.

17 Claims, 4 Drawing Sheets

(51) Int. Cl.

| | |
|---|---|
| ***A43B 7/12*** | (2006.01) |
| ***A43B 13/12*** | (2006.01) |
| ***A43B 13/16*** | (2006.01) |

(56) References Cited

U.S. PATENT DOCUMENTS

| | | | | |
|---|---|---|---|---|
| 2004/0035022 | A1* | 2/2004 | Polegato Moretti | 36/3 B |
| 2005/0252035 | A1* | 11/2005 | Moretti et al. | 36/3 B |
| 2006/0162183 | A1* | 7/2006 | Polegato Moretti | 36/3 B |
| 2009/0193690 | A1* | 8/2009 | Moretti | 36/3 B |
| 2009/0199438 | A1* | 8/2009 | Polegato Moretti | 36/3 B |
| 2009/0211119 | A1* | 8/2009 | Moretti | 36/3 B |
| 2009/0277047 | A1* | 11/2009 | Polegato Moretti | 36/3 B |
| 2010/0011624 | A1* | 1/2010 | Polegato Moretti | 36/3 A |
| 2011/0167678 | A1* | 7/2011 | Peikert | 36/3 R |
| 2012/0311892 | A1* | 12/2012 | Peikert | 36/30 R |
| 2013/0036631 | A1* | 2/2013 | Nabernik | 36/103 |
| 2013/0219755 | A1* | 8/2013 | Polegato Moretti | 36/3 A |
| 2013/0247414 | A1* | 9/2013 | Bier et al. | 36/45 |

FOREIGN PATENT DOCUMENTS

| | | |
|---|---|---|
| JP | 3-162358 | 8/2010 |
| WO | 2007 147421 | 12/2007 |
| WO | 2008 061710 | 5/2008 |

OTHER PUBLICATIONS

International Search Report issued Feb. 6, 2012 in PCT/EP11/067975, filed Oct. 14, 2011.

Office Action issued in Japanese Application No. 2013-539180 on Aug. 4, 2015 (w/ English Translation).

* cited by examiner

VAPOR-PERMEABLE SHOE WITH WATERPROOF AND VAPOR-PERMEABLE SOLE

TECHNICAL FIELD

The present invention relates to a vapor-permeable shoe with waterproof and vapor-permeable sole.

BACKGROUND ART

As is known, the part of the foot that has the greatest perspiration effect is the sole of the foot.

Therefore, the region of the shoe where moisture due to perspiration can accumulate the most is the interface between the sole of the foot and the sole of the shoe.

There, the sweat generated saturates the air with humidity and mostly condenses, stagnating on the insock.

Only a small amount of the moisture produced by sweating spreads to the sides of the upper and exits from them if they are vapor-permeable.

Such effect of sweat stagnation in the plantar region is particularly conspicuous in rubber-sole shoes; in fact, in these cases vapor permeation through the sole is prevented by its total impermeability.

As is known, the stagnation of sweat in the plantar region causes to the user of the shoe a feeling of discomfort and also constitutes a preferential site for the growth of bacterial cultures, which are known to cause bad odors.

Therefore, it is a commonly felt need to obviate the stagnation of moisture from sweating at the plantar region of shoes.

A first attempt aimed at meeting this need consists of the solution proposed in EP 0382904.

The teaching contained in such patent consists in dividing the rubber sole into two layers, the lower one of which has through micro-perforations, and in interposing a semipermeable membrane between the layers, in order to avoid water infiltrations and thus obtain a sole that is impermeable to water in the liquid state and permeable to water vapor.

For the sake of simplicity, hereinafter an element with the property of being impermeable to water in the liquid state and permeable to water vapor is referenced as waterproof and vapor-permeable.

The semipermeable membranes that EP 0382904 teaches to use are for example of the type disclosed in U.S. Pat. No. 4,187,390 and U.S. Pat. No. 4,194,041 by W. L. Gore or U.S. Pat. No. 6,228,477 by BHA Technologies.

Such membranes are provided by means of thin waterproof and vapor-permeable films made of expanded polytetrafluoroethylene, e-PTFE, with thicknesses that vary generally from 15 microns to 70 microns.

Their microstructure is characterized by the presence of dense areas, called nodes, interconnected by stretched filaments, called fibrils.

These semipermeable membranes, conceived initially for the military field, have been developed and used in the clothing and footwear field in order to avoid the accumulation of vapor from sweating in items of clothing and to provide shoes with uppers having waterproof and vapor-permeable linings.

Because the market of the clothing and footwear field has always demanded soft and comfortable items, in the described applications there is a strong need to ensure that the membrane, intended as a functional layer, does not compromise such characteristics.

This need has been expressed as a true technical preconception that has entailed the use of membranes provided with low thicknesses in order to be laminated with supporting and/or aesthetic finishing materials, such as fabric or leather, so as to obtain finished laminated elements that have high characteristics of flexibility, easy bending, softness, surface slipperiness, compressibility and extensibility and low weight per unit surface.

However, the films that provide such membranes have poor characteristics of mechanical strength, precisely because of their low thickness.

In fact, it should be noticed that the strength value of the laminated element derives mainly from the characteristics of the fabric layer or supporting layer to which the membrane is coupled.

In particular, the available films made of polymeric material used to provide said membranes, as mentioned, have thicknesses generally from 15 microns to 70 microns, which give them poor penetration resistance, i.e., lower than 5 N.

The expression "penetration resistance" designates the characteristic defined by a measurement performed according to the method illustrated in the ISO 20344-2004 standard, chapter 5.8.2 "Determination of the penetration resistance of the sole", regarding safety footwear.

Such poor mechanical penetration resistance has brought the inventor of EP 0382904 to prevent contact of the membrane with foreign objects by limiting the diameter of the sole holes that the membrane faces.

This solution, however, has been found to limit the area of the sole assigned to vapor permeation and has also made it easy for the holes to become obstructed, a fact which compromises considerably the vapor permeation efficiency of the sole.

A further solution is proposed in U.S. Pat. No. 6,508,015 by Max Rauch, in which a structure with two superimposed layers is proposed, the upper one, i.e., the one designed to be directed toward the upper part of the shoe, is elastic and permeable to water vapor.

The lower layer, which covers less than 70% of the upper layer, has a supporting function and provides the tread.

The upper layer is made for example of sintered plastics or non-woven fabrics so as to present a microporous structure that in any case is not waterproof.

A drawback of this solution consists in that during use of the shoe, the microporous upper layer, left widely exposed by the lower layer, tends to become impregnated with water when it comes into contact with it, absorbing it, retaining it and partly releasing it over time, dirtying the surfaces on which one walks.

Moreover, the upper layer tends to degrade in contact with the absorbed water.

In order to obtain the waterproofness of the sole, this patent teaches to treat the upper layer so as to render it water-repellent or to cover it with a waterproof and vapor-permeable membrane arranged above it.

However, the hydrophobic treatment is of limited duration, causing the sole to lose its waterproofness.

Besides, the vapor-permeable and waterproof membrane arranged to cover the upper layer is exposed to the action of the insole, which during walking thereon may slip, applying an abrasive action that tends to damage it.

This damage is facilitated by the cyclic flexing and traction stresses to which the membrane is subjected during use of the shoe, which flexes in following the motion of the foot that wears it.

Moreover, the easy accessibility of the membrane by condensed sweat exposes it to the action of residues, such as mineral salts and fatty substances, that may deposit thereon during the evaporation and permeation of the sweat.

Such residues tend to obstruct the pores of the membrane, compromising its permeation efficiency.

DISCLOSURE OF THE INVENTION

The aim of the present invention is to provide a vapor-permeable shoe with waterproof and vapor-permeable sole that allows to overcome the limitations of currently known soles and shoes, particularly by allowing to ensure a greater resistance of the sole to the deterioration factors that tend to compromise its waterproofness and vapor permeability qualities with respect to currently known shoes with vapor-permeable and waterproof sole.

Within this aim, an object of the invention is to provide a shoe with waterproof and vapor-permeable sole that has a greater resistance than currently known shoes against the contaminating action of sweat that condenses inside the foot insertion region.

A further object of the invention is to provide a vapor-permeable shoe with waterproof and vapor-permeable sole that has waterproofness qualities of the sole that are less sensitive than currently known products to the mechanical fatigue sustained during use of the shoe.

This aim and these and other objects that will become better apparent hereinafter are achieved by a vapor-permeable shoe with waterproof and vapor-permeable sole, comprising an upper assembly, a sole, which is joined to said upper assembly and comprises a body made of waterproof material which has a tread and has at least one region that is permeable to water vapor, at least one waterproof and vapor-permeable membrane, which covers said at least one region, toward the inside of said shoe, at least one protective element that covers, at least partially, the lower face of said at least one membrane, said shoe being characterized in that it further comprises at least one waterproof and vapor-permeable protective screen, which is superimposed, toward the inside of said shoe, on said at least one membrane so as to cover it at least partially, said protective screen and said membrane being sealed in a waterproof manner to said body of said sole at at least one sealing zone, which is peripheral to said at least one region.

BRIEF DESCRIPTION OF THE DRAWINGS

Further characteristics and advantages of the invention will become better apparent from the description of preferred but not exclusive embodiments of the vapor-permeable shoe with waterproof and vapor-permeable sole according to the invention, illustrated by way of non-limiting example in the accompanying drawings, wherein.

WAYS OF CARRYING OUT THE INVENTION

Figure 1:
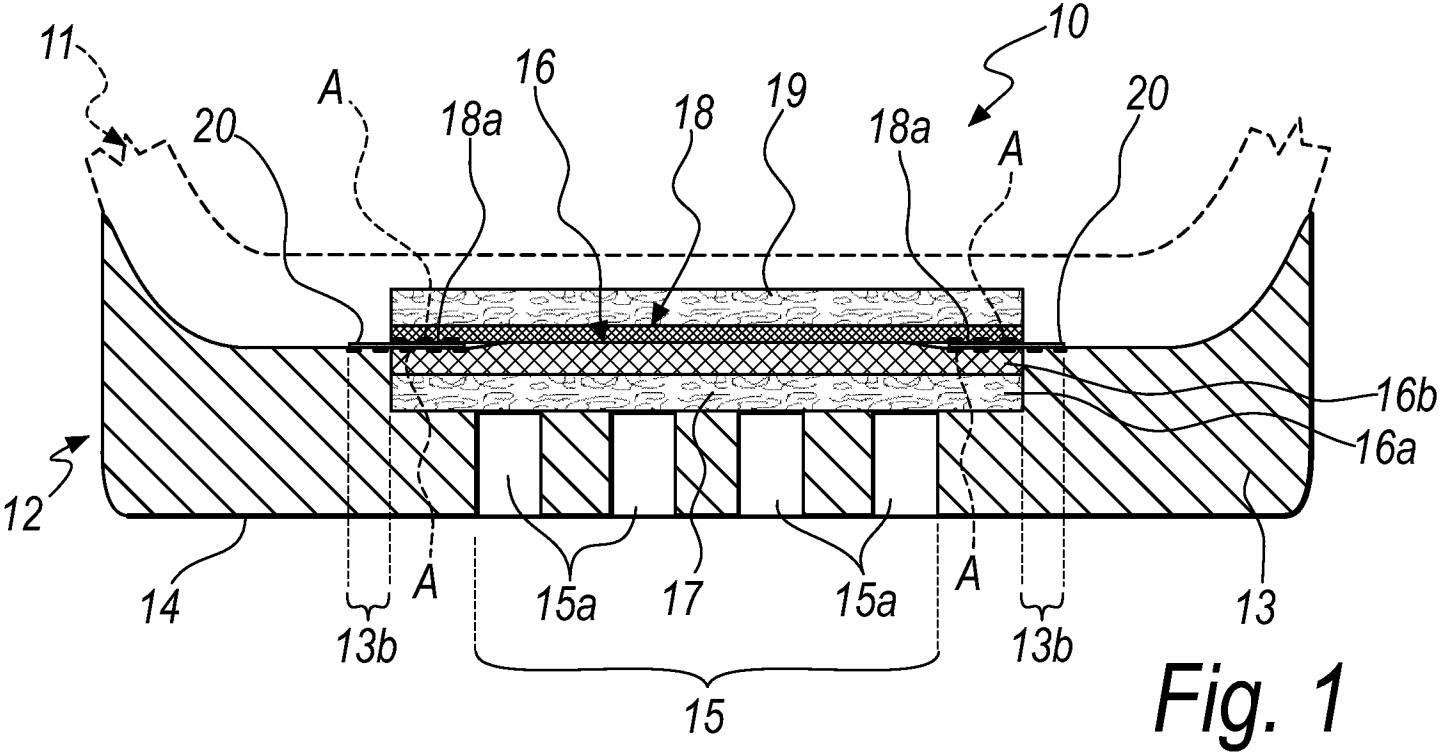
FIG. 1 is an enlarged-scale sectional view of a detail of a shoe according to the invention, in a first embodiment.

With reference to the figures, the reference numeral 10 generally designates a vapor-permeable shoe with waterproof and vapor-permeable sole according to a first embodiment, which comprises an upper assembly 11, a sole 12, which is joined to the upper assembly 11 and comprises a body 13 made of waterproof material that has a tread 14 and has a region 15 that is permeable to water vapor, a waterproof and vapor-permeable membrane 16, which covers the region 15, toward the inside of the shoe 10, a protective element 17 that covers the lower face **16*a* of the membrane 16**.

In general, in alternative embodiments of the invention, the protective element covers at least partially the lower face of the membrane.

According to the invention, the shoe 10 has the peculiarity in that it further comprises a waterproof and vapor-permeable protective screen 18, which is superimposed, toward the inside of the shoe 10, on the membrane 16 so as to cover it.

In general, depending on the execution requirements of the invention, the protective screen covers at least partially the upper face of the membrane.

The protective screen 18 and the membrane 16 are sealed in a waterproof manner to the body 13 of the sole 12 at a sealing zone A, which is peripheral to the region 15, advantageously as described more extensively hereinafter.

The tread 14 conveniently is the lower surface of the body 13, which during use makes contact with the ground, but in an equivalent manner in alternative embodiments of the invention it can be an element that is distinct from said body 13 and is associated with it in a downward region.

Conveniently, the region 15 is defined by a plurality of holes **15*a* that pass through the body 13**.

In alternative embodiments of the invention, in a substantially equivalent manner, said region can be defined by at least one wide opening, in which it is optionally possible to provide structural elements for reinforcing and supporting said protective screen, for example so as to form a lattice.

According to the contingent requirements, in alternative embodiments of a vapor-permeable shoe according to the invention, said shoe comprises a sole that in general has at least one region permeable to the water vapor covered by at least one waterproof and vapor-permeable membrane, below which there is at least one protective element, there being also, at said at least one region, at least one of said protective screen.

Conveniently, the body 13 of the sole 12 is made of waterproof polymeric material that is conveniently selected among polyurethane, PU, thermoplastic polyurethane, TPU, or rubber or thermoplastic rubber, TR.

Advantageously, the protective screen 18 is microporous and has pores with an average aperture of less than 1 μm; preferably, said pores have an average aperture of less than 0.5 μm and in particular conveniently at least 50% of said pores has an average aperture of less than 0.5 μm.

The protective screen 18 is constituted advantageously by a sheet made of material obtained from a substantially uniform mixture composed of a polyolefin with high molecular weight, in a percentile concentration of the volume of said mixture comprised between 8% and 98%, a filler, which is adapted to promote the formation of micropores, in a percentile concentration of the volume of said mixture comprised between 1% and 92%, a plasticizer, in a percentile concentration of the volume of said mixture comprised between 1% and 40%.

Preferably, said polyolefin is a UHMW (Ultra High Molecular Weight) polyethylene, and conveniently said filler is selected among silicon dioxide and silicic acid, said plasticizer being a water-insoluble oil, preferably petroleum oil.

As an alternative, the protective screen 18 is conveniently made of a material selected among expanded polytetrafluoroethylene, e-PTFE, polyurethane, PU, polyester, PES, polypropylene, PP, polyethylene, PE, and the like.

Conveniently, the protective screen 18 has a structure selected among

- a structure constituted by a single integral layer, preferably extruded, having a thickness substantially comprised between 0.1 and 5 mm,
- a structure constituted by a plurality of layers joined by lamination to form a multilayer element whose thickness is substantially comprised between 0.1 and 5 mm,
- a structure constituted by a plurality of laminated layers, a permeable material being provided between them and being cohesive with them.

Moreover, advantageously, the protective screen 18 is associated with a supporting mesh, not shown in the accompanying figures, adapted to facilitate its handling during the manufacture of the shoe 10.

The protective element 17 is conveniently made of a material that is resistant to hydrolysis and vapor-permeable, selected among felt, non-woven fabric and the like, treated so as to be water-repellent, and conveniently having a thickness substantially comprised between 1 mm and 2 mm.

The membrane 16 is conveniently of the type of commonly commercially available vapor-permeable and waterproof membranes, for example made of expanded polytetrafluoroethylene, e-PTFE, polyurethane, PU, or the like, and at least one mesh that reinforces it is conveniently associated therewith.

Conveniently, the shoe 10 comprises also a spacer 19 that is vapor-permeable and is superimposed at least partially on the protective screen 18 so as to protect it.

The spacer 19 has the main purpose of protecting the protective screen 18 against any abrasive action of the insole that can be provided in the shoe 10.

The spacer 19 is preferably made of vapor-permeable or perforated material, for example felt, or fabric, or plastic material or cellulose material.

Conveniently, the shoe 10 comprises a sealing element 20, adapted to seal in a waterproof manner the membrane 16 and the protective screen 18 to the body 13.

In particular, the sealing element 20 is arranged so as to connect, providing a waterproof seal, the perimetric edge 16*b* of the membrane 16, the perimetric flap 18*a* of the protective screen 18, and a zone of the body 13, that surrounds the membrane 16, designated by the reference numeral 13*b*.

The perimetric edge 16*b* and the perimetric flap 18*a*, together with the zone 13*b* that surrounds the membrane 16, define conveniently the sealing zone A.

The sealing element 20 is conveniently made of waterproof polymeric material and adheres so as to provide a seal to the perimetric edge 16*b*, to the perimetric flap 18*a* and to the body 13 with a layer of glue that is resistant to hydrolysis and capable of ensuring an effective seal, preferably of the polyurethane type.

As an alternative, the sealing element 20 may be replaced, in a substantially equivalent manner, by a layer of glue preferably of the polyurethane type.

The waterproof polymeric material of which the sealing element 20 is preferably made is polyvinyl chloride, PVC, or thermoplastic polyurethane, TPU, or ethylene-vinyl acetate, EVA, or the like.

In alternative and substantially equivalent embodiments, the sealing element is advantageously a film of hot-melt thermoplastic adhesive, made of polyurethane or polyester, polyamide or polyolefins, that can be activated by means of heat and pressure.

A film particularly adapted for providing said sealing element is proposed commercially by the firm Bemis Associates Inc with product code 3218, or by the firm Collano AG, XIRO Adhesive Films with product code XAF 36.004 (Puro).

In an alternative embodiment of the invention, the waterproof sealing connection of the membrane and of the protective screen to the body of the sole is provided by the material that constitutes the body of the sole, or of a component thereof, which is injected in the mold during the molding step, which grips the membrane and the protective screen.

In particular, in this case, said sealing connection is obtained by co-molding on the membrane and on the protective screen the material that forms the body of the sole, or of a component thereof, such as for example a midsole.

In this manner, in fact, the forming material of the body of the sole, or of its component, grips, so as to provide a waterproof seal, the membrane and the protective screen, in order to define said sealing zone, which is peripheral to the water vapor-permeable region of the sole.

Figure 2:
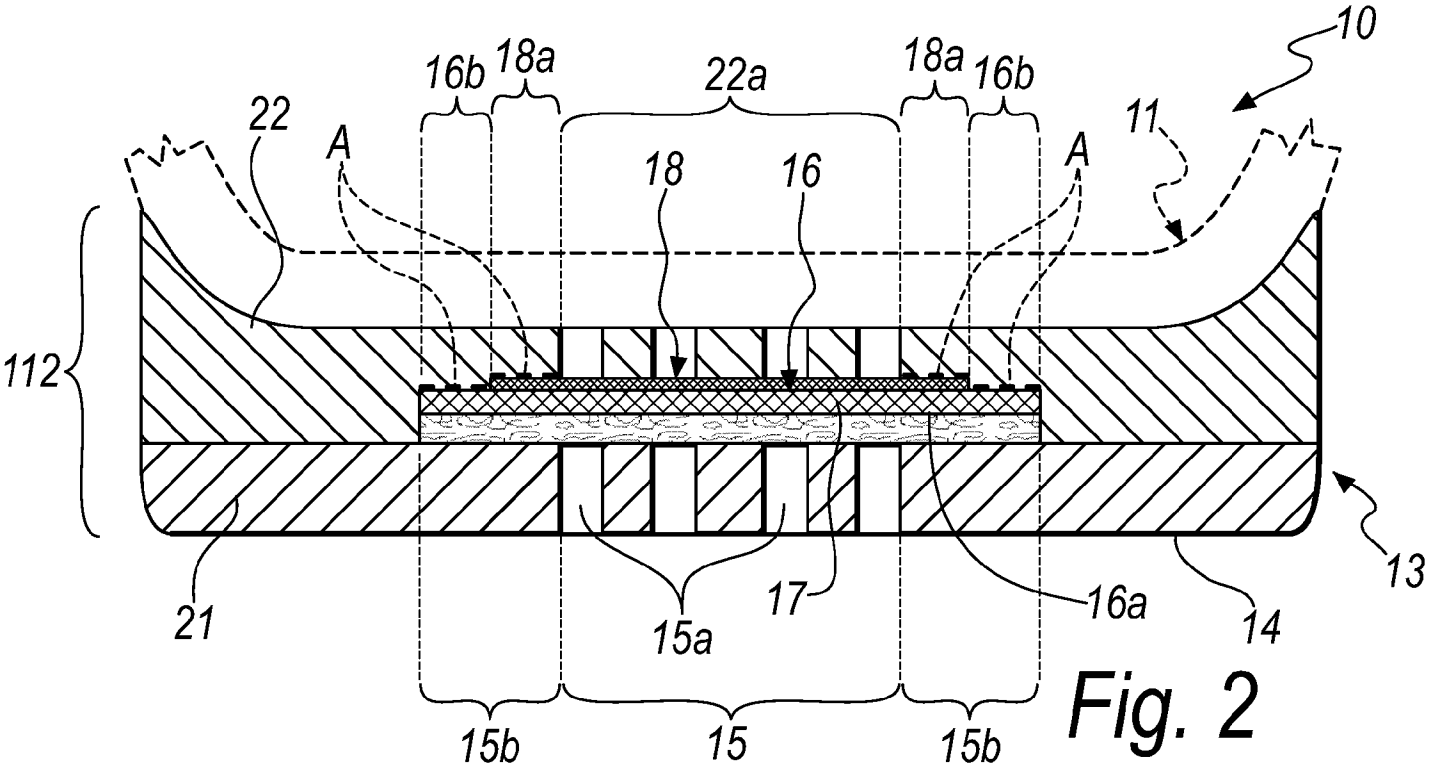
FIG. 2 is an enlarged-scale sectional view of a detail of a shoe according to the invention, in a second embodiment.

In a second embodiment of the shoe 10 according to the invention, illustrated by way of non-limiting example in FIG. 2, where the elements that correspond to those described so far are designated by the same reference numerals, the sole, designated by the reference numeral 112, has the body 13 that comprises a lower portion 21 and an upper portion 22.

The protective screen 18 and the membrane 16 are sealed to the upper portion 22 in a zone 15*b* that is perimetric to the region 15 and defines the sealing zone, which is illustrated by way of non-limiting example in FIG. 2 with a dotted line segment designated by the reference letter A.

Preferably, the membrane 16 has the perimetric edge 16*b* exposed by the protective screen 18.

Thus, the zone A for sealing the membrane 16 and the protective screen 18 to the body 13 is defined by the sealing connection thereof to the perimetric flap 18*a* of the protective screen 18, and to the perimetric edge 16*b*.

Advantageously, the protective screen 18 and the membrane 16 are glued, so as to provide a waterproof seal, to the upper portion 22, at the perimetric zone 15*b*; in this case, the upper portion 22 and the lower portion 21 are preferably mutually joined so as to provide a waterproof seal by gluing.

As an alternative, the upper portion 22 is conveniently sealed in a waterproof manner to the protective screen 18 and to the membrane 16 by griping of the material that forms the upper portion 22 during its co-molding on the lower portion 21, on the protective screen 18 and on the membrane 16.

In this case, conveniently, the lower portion 21 is sealed to the upper portion 22 by gripping of the material that forms the upper portion 22 during its co-molding on the lower portion 21, on the protective screen 18 and on the membrane 16.

The upper portion 22 preferably has a central portion 22*a* that selectively has holes or at least one through opening, which define part of the region 15.

In an alternative embodiment of the invention, not shown in the accompanying figures, the central portion 22*a* is replaced by an insert made of vapor-permeable or perforated material, for example felt or fabric or plastic material or cellulose material.

In this case, said insert has the function of protecting the protective screen from the material for forming the upper part of the body of the sole, when the latter is provided by co-molding on the lower part, on the protective screen and on the membrane.

Figure 3:
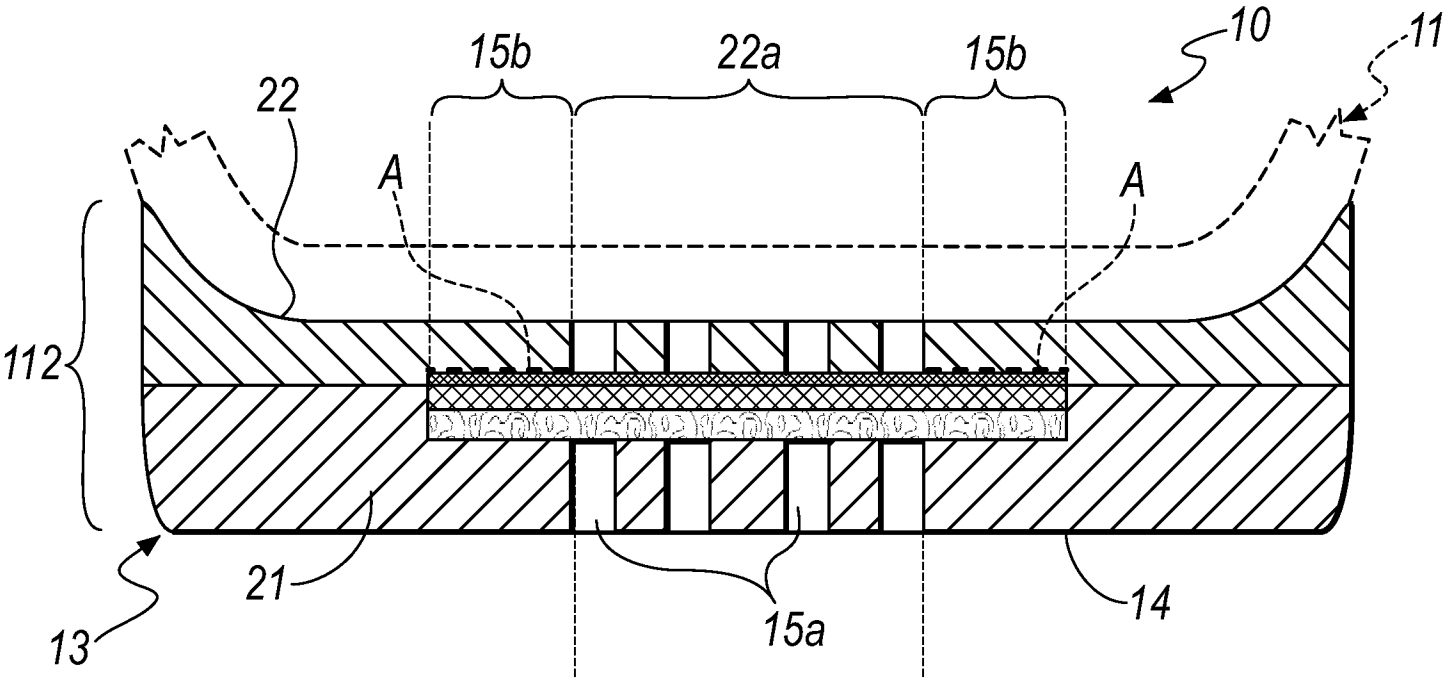
FIG. 3 is an enlarged-scale sectional view of a detail of a shoe according to the invention, in a variation of said second embodiment.

With particular reference to FIG. 3, in a variation of said second embodiment, the protective screen covers the membrane 16, being perimetrically sealed thereto for example by gluing.

In this case, the upper portion 22 is sealed to the protective screen 18 by gluing or, as an alternative, by co-molding of the material of which it is made, on the protective screen 18 and on the lower portion 21.

In a constructive variation of said second embodiment, not shown further in the accompanying figures, depending on the execution requirements of the invention the body 13 of the sole 112 is in a single piece, the lower portion and the upper portion being formed together by injection in a mold on the pack that comprises the membrane 16 covered in a downward region by the protective element 17 and in an upward region, at least in its central part, by the protective screen 18.

Figure 4:
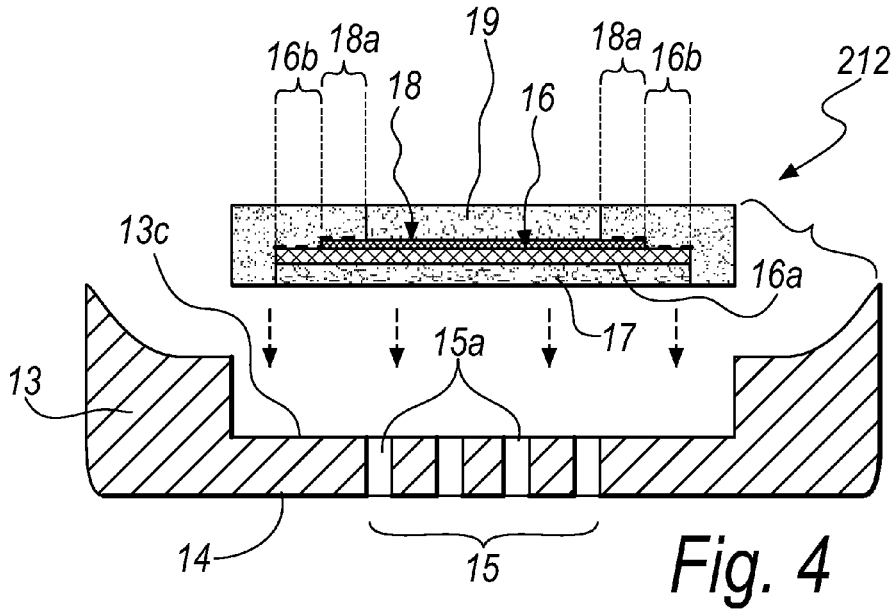
FIGS. 4 and 5 are respectively a partially exploded and an assembled enlarged-scale sectional view of a detail of a shoe according to the invention, in a third embodiment.
Figure 5:
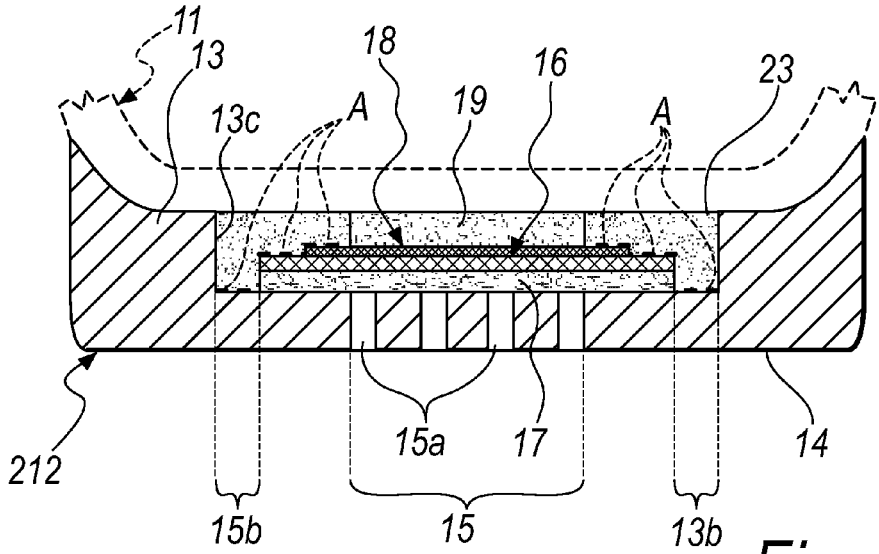

In a third embodiment of a shoe 10 according to the invention, illustrated by way of non-limiting example in FIGS. 4 and 5, where the elements that correspond to those described so far are also designated by the same reference numerals, the sole designated by the reference numeral 212 comprises the body 13, which has a central seat 13*c* for accommodating a sealing insert 23 adapted to seal in a waterproof manner the membrane 16 and the protective screen 18 to the body 13.

In particular, the sealing insert 23 is inserted in the body 13 so as to connect, providing a waterproof seal, the perimetric edge 16*b* of the membrane 16, the perimetric flap 18*a* of the protective screen 18, and a zone of the body 13 that surrounds the membrane 16, also designated by the reference numeral 13*b*.

Preferably, the sealing insert 23 is made of polymeric material, for example polyurethane, PU, thermoplastic rubber, TPR, polyvinyl chloride, PVC, or ethylene vinyl acetate, EVA, or the like.

The membrane 16 conveniently, has its perimetric edge 16*b* exposed by the protective screen 18, the perimetric edge 16*b* and the perimetric flap 18*a* being sealed to the sealing insert 23.

Thus, the perimetric edge 16*b* and the perimetric flap 18*a*, together with the zone 13*b* that surrounds the membrane 16, conveniently define the sealing zone A.

This sealing connection is conveniently provided selectively by gluing or by co-molding of the sealing insert 23 on the protective screen 18 superimposed on the membrane 16.

The sealing insert 23 may advantageously be provided separately from the body 13 and hermetically joined to the protective screen 18 superimposed on the membrane 16 and subsequently hermetically glued to the body 13.

Alternatively, the sealing insert 23 can be co-molded thereon and on the protective screen 18 that is superimposed on the membrane 16.

In particular, therefore, the sealing insert 23 is conveniently provided separately, and during the assembly of the sole 212 is glued so as to provide a waterproof seal in the central seat 13*c*, conveniently by means of a layer of glue that is resistant to hydrolysis and capable of ensuring an effective waterproof seal.

As an alternative, the sealing insert 23 is conveniently co-molded on the body 13, the polymeric material for forming it adhering so as to form a waterproof seal, by gripping, during the injection in a mold the perimetric flap 18*a* of the protective screen 18, the perimetric edge 16*b*, and the body 13 in the zone 13*b* that surrounds the membrane 16.

Advantageously, there is also the spacer 19, which is permeable to water vapor and is superimposed to the protective screen 18 so as to cover it at least partially in order to protect it against any abrasive action that the insole might apply thereto during use.

In FIG. 5, the combined sealing zone between the membrane 16, the protective screen 18 and the body 13 of the sole 212 is represented by means of segments of a dotted line, designated by the reference letter A.

In practice it has been found that the invention fully achieves the intended aim and objects, by providing a vapor-permeable shoe with waterproof and vapor-permeable sole that allows to overcome the limitations of currently known soles and shoes, particularly allowing to ensure a higher resistance of the sole against the deterioration factors that tend to compromise its waterproofness and vapor permeability qualities, with respect to currently known shoes with vapor-permeable and waterproof sole, thanks to the presence of the protective screen that protects the membrane and cooperates with it to ensure the waterproofness and breathability of the sole.

A shoe with waterproof and vapor-permeable sole according to the invention, moreover, is more resistant than currently known shoes to the contaminating action of sweat that condenses within the foot insertion region; this condensation is in fact blocked by the protective screen, which prevents its access to the membrane, preserving it from contaminations.

Moreover, a vapor-permeable shoe with waterproof and vapor-permeable sole according to the invention has sole breathability qualities that are less sensitive than currently known products to the mechanical fatigue sustained during use of the shoe thanks to the simultaneous presence of the membrane and of the protective screen, which cooperate so as to ensure durable waterproofness of the sole while allowing its breathability.

The invention thus conceived is susceptible of numerous modifications and variations, all of which are within the scope of the appended claims; all the details may further be replaced with other technically equivalent elements.

In practice, the materials used, so long as they are compatible with the specific use, as well as the contingent shapes and dimensions, may be any according to requirements and to the state of the art.

The disclosures in Italian Patent Application No. PD2010A000348 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A vapor-permeable shoe with waterproof and vapor-permeable sole, comprising:

an upper assembly;

a sole joined to the upper assembly and comprising a body made of waterproof material including a tread and at least one region that is permeable to water vapor;

at least one waterproof and vapor-permeable membrane, which covers the at least one region, toward an inside of the shoe;

at least one protective element, which covers at least partially a lower face of the at least one membrane; and at least one waterproof and vapor-permeable protective screen, which is superimposed, toward the inside of the shoe, on the at least one membrane so as to cover it at least partially, the protective screen and the membrane being sealed in a waterproof manner to the body of the sole at at least one sealing zone, the sealing zone being peripheral to the at least one region.

2. The shoe according to claim 1, wherein the at least one protective screen is microporous and includes pores with an average aperture of less than 1 μm.

3. The shoe according to claim 1, wherein the at least one protective screen comprises a sheet made of a material obtained from a substantially homogeneous mixture composed of:

a high molecular weight polyolefin, at a percentile concentration of the volume of the mixture comprised between 8% and 98%, a filler adapted to promote the formation of micropores, at a percentile concentration of the volume of the mixture comprised between 1% and 92%, a plasticizer, at a percentile concentration of the volume of the mixture comprised between 1% and 40%.

4. The shoe according to claim 3, wherein the polyolefin is an UHMW (Ultra High Molecular Weight) polyethylene.

5. The shoe according to claim 1, wherein the at least one protective screen is made of a material selected from polytetrafluoroethylene, polyurethane, polyester, polypropylene, polyethylene.

6. The shoe according to claim 5, wherein the at least one protective screen has a structure selected from:

a structure constituted by a single integral layer with a thickness substantially comprised between 0.1 mm and 5.0 mm, a structure constituted by a plurality of layers joined by lamination so as to form a multilayer element having a thickness comprised substantially between 0.1 and 5.0 mm, a structure constituted by a plurality of laminated layers, a permeable material being provided between them and being cohesive with them.

7. The shoe according to claim 1, further comprising at least one spacer which is vapor-permeable and is superimposed at least partially on the at least one protective screen so as to protect it.

8. The shoe according to claim 1, further comprising a sealing element, which is arranged so as to connect, providing a waterproof seal, a perimetric edge of the at least one membrane, a perimetric flap of the at least one protective screen, and a zone of the body that surrounds the at least one membrane, the perimetric edge, the perimetric flap, and the surrounding zone defining the at least one sealing zone.

9. The shoe according to claim 8, wherein the sealing element is made of polymeric material.

10. The shoe according to claim 8, wherein the at least one membrane includes the perimetric edge exposed by the at least one protective screen, the at least one protective screen and the at least one membrane being sealed to a zone that is perimetric to the region.

11. The shoe according to claim 1, wherein the body comprises a lower portion and an upper portion, the at least one protective screen being sealed to the upper portion in a zone that is perimetric to the region, so as to define the at least one sealing zone.

12. The shoe according to claim 11, wherein the upper portion includes a central portion which includes selectively holes or at least one through opening, which define part of the region.

13. The shoe according to claim 11, wherein the at least one protective screen and the upper portion, at the perimetric zone, are glued so as to provide a waterproof seal.

14. The shoe according to claim 11, wherein the upper portion is sealed in a waterproof manner to the at least one protective screen by gripping of the material for forming the upper portion during its co-molding on the lower portion and on the at least one protective screen.

15. The shoe according to claim 8, further comprising a sealing insert made of polymeric material, which is inserted in the body so as to connect providing a waterproof seal, the perimetric edge of the at least one membrane, the perimetric flap of the at least one protective screen, and a zone of the body that surrounds the at least one membrane.

16. The shoe according to claim 15, wherein the at least one protective screen and the sealing insert are glued so as to provide a waterproof seal.

17. The shoe according to claim 15, wherein the sealing insert is sealed in a waterproof manner to the at least one protective screen by gripping of the material that forms the sealing insert during its co-molding on the at least one protective screen.

* * * * *